United States Patent [19]

Elders

[11] 4,119,027

[45] Oct. 10, 1978

[54] REFUSE COMPACTOR

[75] Inventor: Alvin J. Elders, Evansville, Ind.

[73] Assignee: Whirlpool Corporation, Benton Harbor, Mich.

[21] Appl. No.: 397,831

[22] Filed: Sep. 17, 1973

[51] Int. Cl.[2] ..... B30B 15/30

[52] U.S. Cl. ..... 100/215; 100/226; 100/229 A; 100/295

[58] Field of Search ..... 100/215, 226, 228, 229 A, 100/290, 295

[56] References Cited

U.S. PATENT DOCUMENTS

| | | | |
|---|---|---|---|
| 594,008 | 11/1897 | Hanak | 100/226 |
| 3,145,647 | 8/1964 | Dinkov | 100/229 A |
| 3,285,505 | 11/1966 | Katz | 100/229 A |
| 3,691,944 | 9/1972 | Boyd | 100/229 A |
| 3,772,984 | 11/1973 | Karls | 100/229 A |
| 3,807,299 | 4/1974 | Engebretsen | 100/229 A |
| 3,838,635 | 10/1974 | Hardy | 100/215 |

*Primary Examiner*—Billy J. Wilhite

*Attorney, Agent, or Firm*—Wegner, Stellman, McCord, Wiles & Wood

[57] ABSTRACT

A refuse compactor having an auxiliary loading means for introducing small refuse elements into the compacting container for obviating the need to move the compacting container to the normal fully exposed refuse loading position exteriorly of the compactor cabinet. A door may be used to control the small access opening. The compacting ram is disposed at the top of the compacting container in the retracted position and is constructed to define a passage for movement of refuse from the auxiliary opening into the container notwithstanding the disposition of the ram means therebetween.

23 Claims, 5 Drawing Figures

REFUSE COMPACTOR

BACKGROUND OF THE INVENTION

1. Field of the Invention

This invention relates to compacting apparatus, and in particular to refuse compactors such as for household use.

2. Description of the Prior Art

In one form of conventional refuse compactor, a drawer is movably mounted in a cabinet for selective disposition within the cabinet in a compacting position wherein a ram moves downwardly into the drawer to compact refuse previously placed therein. As a result of such compacting of the refuse, substantial quantities of refuse may be compacted before requiring transfer to disposal means such as conventional trash pickup garbage cans.

The drawer is conventionally moved to an accessible position exteriorly of the cabinet to permit placing of the refuse thereinto in a loading position. Further, disposition of the drawer in the loading position provides free access thereto for removal of the compacted refuse when desired.

It has been found that when only a small piece of trash, such as a facial napkin, bottle, or the like, is to be placed in the drawer, the movement of the relatively large drawer to the fully accessible loading position is relatively troublesome. One solution to this problem has been to arrange the compactor so that the drawer need only be opened partway to accept such small refuse items. This solution is not fully satisfactory in that where a substantial amount of trash has been previously compacted in the drawer, even the limited movement of the drawer is somewhat relatively bothersome because of the relatively large weight which has to be moved to accommodate introduction of such a small trash item.

In certain compactors, means for providing access as for introducing the refuse into the container may comprise a small opening above the level of the container in the outer cabinet. One example of such a compactor is shown in U.S. Pat. No. 3,691,944 of John A. Boyd for a Kitchen Compactor. In this patent, the ram, or pressing platen, is spaced above the compacting container in the retracted position to permit introduction of the refuse into the top of the container through an access opening in the front of the cabinet. The container is maintained within the cabinet at all times until the container is filled with compacted refuse, whereupon the entire front wall of the cabinet and movable platform means is withdrawn from the compactor to permit removal of the compacted refuse. The ram means is maintained effectively, at all times, in a preselected configuration and is moved by water pressure between the retracted and compacting positions thereof.

A further form of refuse disposing device comprises a refuse incinerator having an associated compactor as shown in U.S. Pat. No. 2,978,999 to Robert F. Smith entitled Incinerator with Compactor. In said patent, a waste material inlet opening is provided in the upper portion of the cabinet for feeding refuse into a combustion chamber. A compactor is disposed below the combustion chamber for compacting the products of combustion before introduction thereof into a subjacent disposal receptacle.

Baling machines showing structure somewhat pertinent to the present invention are illustrated in U.S. Pat. No. 1,603,204 to J. Hansen for a Power Baling Machine, and 3,145,647 to I. V. Dinkov et al for a Cart Filling and Baling Machine.

SUMMARY OF THE INVENTION

The present invention comprehends an improved refuse compactor of the type having a drawer for defining the movable container in which the refuse is compacted and which is normally movable between a compacting position within the cabinet to a loading position forwardly of the cabinet. The invention comprehends providing, in combination with such a structure, an auxiliary means for introducing small refuse items into the drawer container without the necessity for moving the drawer to the normal loading position.

The invention further comprehends providing in such a structure a ram which is disposed in a retracted position closely above the drawer so that the ram, in effect, covers the top of the drawer at such time. Means are provided in the apparatus for altering the configuration of the ram so as to define a passage for such small refuse items from an access opening in the cabinet to the subjacent drawer container. In the compacting arrangement of the ram, a pressure plate portion of the ram is positively locked in a compacting arrangement which effectively eliminates the trash guiding passage and causes the ram means to define a rigid ram structure capable of handling the tons of force involved in such compacting operations.

In the illustrated embodiment, the pressure plate is movably mounted on a support structure of the ram means and means are provided for moving the pressure plate between the compacting disposition and a retracted disposition wherein the ram means defines the trash guiding passage. Cam means may be provided for effecting such selective disposition of the ram means automatically as a function of the movement of the ram means between the compacting position and the retracted position.

More specifically, the pressure plate may be pivotally mounted to the support structure of the ram means and linkage means may be connected therebetween for guiding the pressure plate to a compacting position horizontally across the bottom of the support structure and a retracted position extending angularly upwardly from a rear portion of the bottom of the support structure. Thus, in the retracted position, side walls of the ram means support structure cooperate with the pressure plate to effectively define a chute for guiding the small refuse items through the ram structure into the container without the necessity for moving the drawer to the normal loading position.

The cabinet may be provided with a small access opening in the front wall thereof to define the means for introducing the small refuse items through the ram into the compacting container. A door may be movably mounted to the cabinet for selectively closing the small access opening.

Broadly, therefore, the invention comprehends the provision of a refuse compactor including a container defining a compacting space in which refuse is disposed to be compacted, ram means, means for moving the ram means selectively between a retracted position adjacent the container and a compacting position wherein the ram engages and forcibly compacts the refuse in the container, means for disposing the container selectively in a compacting position adjacent the ram and a loading position providing substantially free access to the container for facilitated introduction of refuse thereinto, and means for causing the configuration of the ram means in the retracted position to be different from that of the ram means in the compacting position to provide limited access to the container for introduction of small trash elements into the container in the compacting position notwithstanding the disposition of the ram means adjacent the container.

More specifically in the illustrated embodiment, the refuse compactor defines a cabinet, a drawer defining an upwardly opening compacting space in which refuse is disposed to be compacted, ram means, means for moving the ram means selectively between a retracted position adjacent the top of the drawer and a compacting position wherein the ram engages and forcibly compacts the refuse in the drawer, means for disposing the drawer selectively in a compacting position within the cabinet below the ram and a loading position forwardly of the cabinet providing substantially free access to the drawer for facilitated introduction of refuse thereinto, means defining an access opening in the cabinet above the drawer, and means for causing the configuration of the ram means in the retracted position to be different from that of the ram means in the compacting position to provide limited access to the drawer for introduction of small trash elements through the access opening into the drawer within the cabinet in the compacting position notwithstanding the disposition of the ram means of the top of the drawer.

Thus, the refuse compactor of the present invention is extremely simple and economical of construction while yet providing the advantages discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
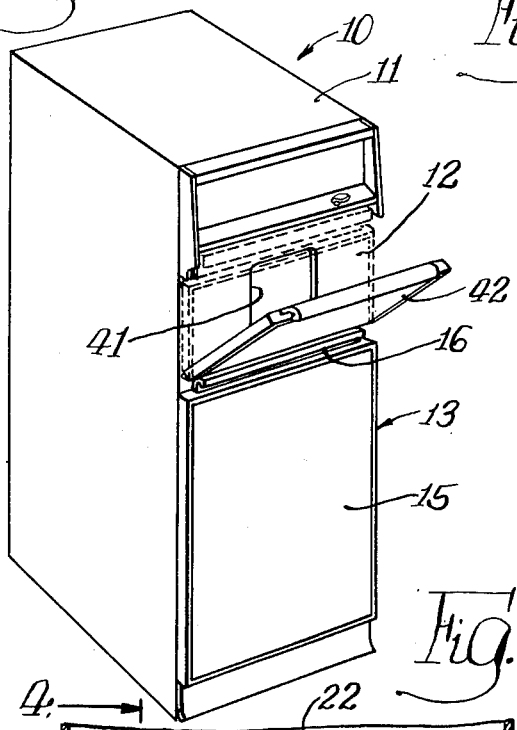
FIG. 1 is a perspective view of a refuse compactor embodying the invention.

In the exemplary embodiment of the invention as disclosed in the drawing, a refuse compactor generally designated 10 is shown to comprise an outer cabinet 11 having a front wall 12. A container 13 in the form of a drawer is movably carried in the cabinet for selective disposition in a compacting position within the cabinet and a loading position (shown fragmentarily in dotted lines in FIG. 2) forwardly of the cabinet front wall 12. The compactor further includes ram means 14 adapted to compact refuse placed in the drawer with the ram means being movable between a lower, compacting position within the drawer, as shown in full lines in FIG. 5, and an upper, retracted position immediately above the drawer, as shown in FIG. 4.

Drawer 13 includes a front panel 15 and a manipulating handle 16. In the compacting position of the drawer, panel 15 is substantially flush with the front wall 12 of the cabinet, and in the loading position, the drawer is disposed substantially fully forwardly of the cabinet front wall for facilitated access to the interior thereof both for loading purposes and for removal of compacted refuse as desired. The drawer may be carried on suitable guide means 17 for facilitated movement between compacting and accessible positions.

Ram means 14 includes a support structure 18 and a pressure plate 19 cooperatively defining means adapted to move downwardly through the open top 20 of drawer container 13 to effect the desired compaction of refuse in the drawer. The ram effectively defines a parallelepiped, box-like structure including side walls 21 and a top housing portion 22 with the pressure plate extending horizontally across the lower end of the support structure 18, as shown in FIG. 5.

Figure 4:
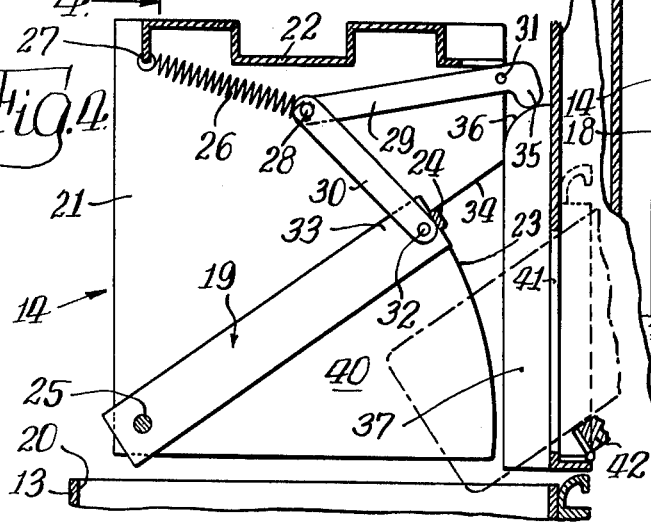
FIG. 4 is a fragmentary horizontal section taken substantially along the line 4—4 of FIG. 3.
Figure 5:
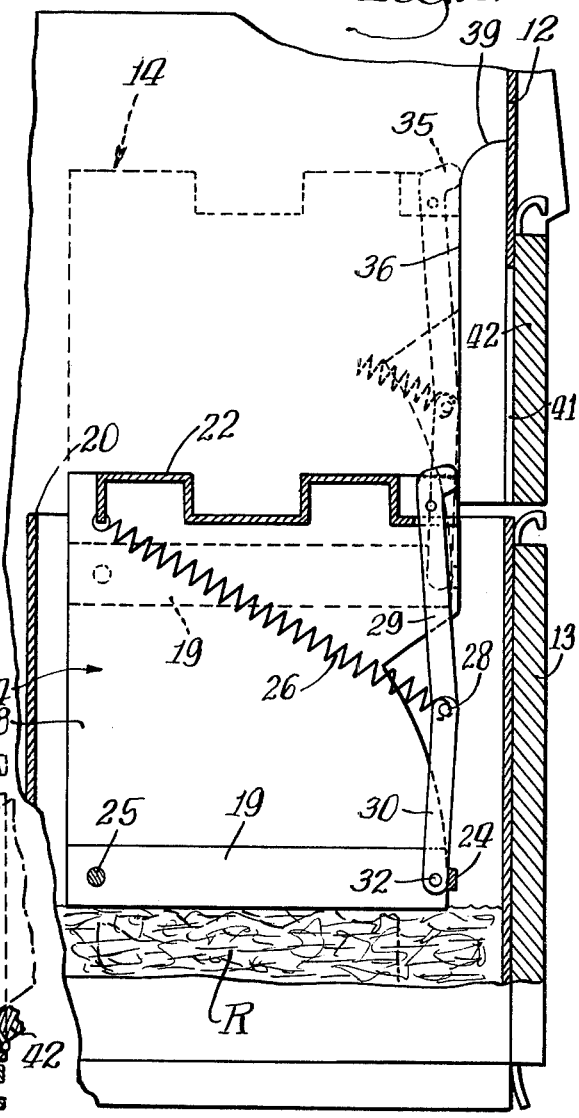
FIG. 5 is a fragmentary vertical section similar to that of FIG. 4 but illustrating the arrangement of the ram means in the compacting position in full lines and in the retracted position in dotted lines.

Side walls 21 define arcuate front edges 23 cooperating with a guide bar 24 on the pressure plate 19 to guide the pressure plate pivotally about the axis of pivots 25 mounting the pressure plate to the spaced side walls 21 for swingable positioning between the compacting arrangement across the bottom of structure 18, as shown in FIG. 5, and a retracted arrangement extending forwardly and upwardly from the pivots 25 as shown in FIG. 4.

Pressure plate 19 is urged to the retracted position by a spring 26 having one end connected to a lug 27 on ram housing portion 22 and the opposite end connected to a pivotal connection 28 between a pair of links 29 and 30 defining a toggle. The distal end of each link 29 is pivotally connected to the adjacent side wall 21 by a pivot 31 and the distal end of each link 30 is connected to the adjacent side of pressure plate 19 by a pivot 32. Thus, as shown in FIG. 4, spring 26 biases the toggle arrangement of links 29 and 30 to a folded position wherein the forward end 33 of pressure plate 19 is brought upwardly to engage bar 24 with a stop surface 34 on each of side walls 21 to maintain the pressure plate in the raised, retracted position when the ram means is in its retracted position above drawer 13, as shown in FIG. 4.

The distal end of link 29 further defines a cam follower 35 which slides against cam surface 36 of a cam 37 fixedly secured to the frame portion of the cabinet 11 rearwardly of front wall 12. Ram means 14 is moved vertically by suitable rotation of a pair of vertical drive screws 38 engaging suitable cooperating threaded means (not shown) in ram housing portion 22 at opposite sides of the ram. As ram means 14 is brought downwardly by suitable rotation of screws 38 to effect the compacting operation, cam follower 35 is caused to slide along cam surface 36 to substantially immediately swing the articulated linkages 29 and 30 to an in-line, or columnar, relationship, as shown in dotted lines in FIG. 5, against the action of spring 26. Further downward movement maintains the linkages in the substantially aligned columnar arrangement to lock the pressure plate 19 in the compacting position across the bottom of the ram means to effect compacting of the refuse R in drawer 13 as shown in FIG. 5.

Reverse rotation of the drive screws 38 effects upward movement of ram means 14 with the ram means being arranged in the compacting configuration until cam follower 35 once again reaches the upper rounded end 39 of cam surface 36, permitting spring 26 to flex the toggle and retract pressure plate 19 to the angled retracted position of FIG. 4.

Figure 2:
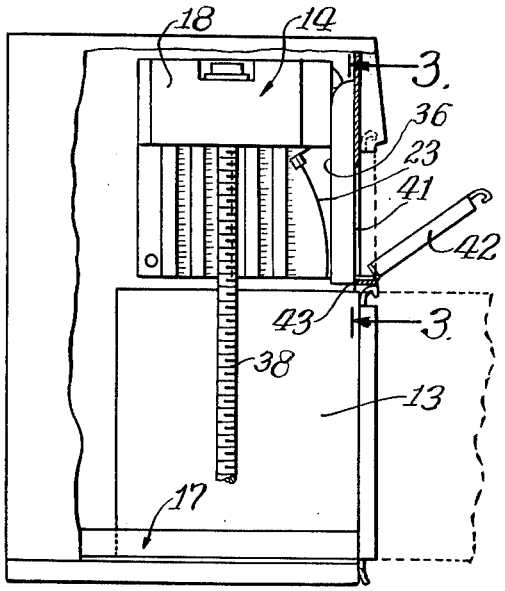
FIG. 2 is a side elevation thereof with portions broken away.
Figure 3:
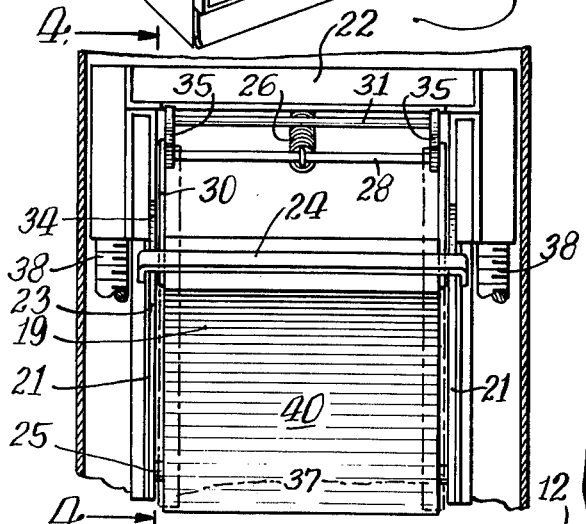
FIG. 3 is a fragmentary vertical section taken substantially along the line 3—3 of FIG. 2.

As best seen in FIGS. 3 and 4, in the retracted position of the pressure plate 19, the ram effectively defines a passage 40 below the angled pressure plate and between the side walls 21 opening downwardly to the open top 20 of the drawer container 13. Front wall 12 of cabinet 11 is provided with a small access opening 41, as shown in FIGS. 1, 2 and 5, which is normally closed by a door 42 movably mounted to the cabinet by a suitable hinge 43. Access opening 41 opens directly to the ram passage 40 with the ram disposed immediately rearwardly of the front wall 12, as shown in FIG. 4. Thus, small refuse items may be passed through access opening 41 and ram passage 40 into the refuse container drawer 13 without the need for moving the drawer to the forwardly disposed normal loading position. In such functioning, the side walls 21 and pressure plate 19 cooperatively define a chute for guiding the refuse through passage 40, effectively preventing such refuse from passing undesirably to other portions of the interior of cabinet 11.

Thus, the invention comprehends the provision of means for causing the configuration of ram means 14 in the retracted position to differ from that of the ram means in the compacting position, thereby to provide limited access to the drawer for introduction of small trash elements into the drawer in the compacting position notwithstanding the disposition of the ram means in an overlying position closely adjacent the top of the container. The change in configuration of the ram means is automatically effected as a function of the movement of the ram means between the retracted and compacting positions. The change is effected by a selective positioning of a pressure plate portion at the bottom of the ram means under the control of biased guiding means and cooperating cam means for facilitated selective positioning. In the compacting arrangement, the ram means is locked in a strong box-like configuration with the substantial pressure forces generated being readily accommodated by the columnar arrangement of the articulated links. The novel functioning of the present structure is effected by selectively providing a passage through the ram structure itself for defining means for guiding small trash items into the container drawer in the retracted arrangement of the compactor.

The foregoing disclosure of specific embodiments is illustrative of the broad inventive concepts comprehended by the invention.

The embodiments of the invention in which an exclusive property or privilege is claimed are defined as follows:

1. A refuse compactor comprising:

a cabinet;

a container defining a compacting space in which refuse is disposed to be compacted and having an open portion through which refuse may be passed;

means for movably mounting the container to the cabinet for selective positioning in a compacting position within the cabinet and an access position outwardly of the cabinet for facilitated introduction of gross amounts of refuse thereinto;

ram means in said cabinet;

means for moving the ram means selectively between a retracted position adjacent the container open portion with the container in the compacting position and a compacting position wherein the ram engages and forcibly compacts the refuse in the container in its compacting position;

means for causing the configuration of the ram means in the retracted position to be different from that of the ram means in its compacting position to define a small delivery passage within the cabinet providing limited access to the container open portion in the compacting position of the container; and means providing controlled access to said delivery passage for introduction of small amounts of refuse through the delivery passage into the container with the container being disposed within the cabinet in its compacting position notwithstanding the disposition of the ram means adjacent the container.

2. The refuse compactor of claim 1 wherein means are provided for causing the ram means to change its configuration as an incident of the movement of the ram means to the retracted and compacting positions.

3. The refuse compactor of claim 1 wherein cam means are provided for causing the ram means to change its configuration as an incident of the movement of the ram means to the retracted and compacting positions.

4. The refuse compactor of claim 1 wherein the ram means in the retracted position is disposed at the top of the container and defines a passage therethrough opening from the front of the ram means through the bottom of the ram means for passing said small amounts of refuse from above the front of the container downwardly through the ram means into the container.

5. The refuse compactor of claim 1 wherein means are provided for biasing the ram means to the configuration wherein it provides said limited access in the retracted position.

6. A refuse compactor comprising: a container defining a compacting space in which refuse is disposed to be compacted; ram means; means for moving the ram means selectively between a retracted position adjacent the container and a compacting position wherein the ram engages and forcibly compacts the refuse in the container; means for disposing the container selectively in a compacting position adjacent the ram and a loading position providing substantially free access to the container for facilitated introduction of refuse thereinto; and means for causing the configuration of the ram means in the retracted position to be different from that of the ram means in the compacting position to provide limited access to the container for introduction of small trash elements into the container in the compacting position notwithstanding the disposition of the ram means adjacent the container, said ram means comprising a support structure, a pressure plate at the bottom of the support structure, and means for pivotally mounting the pressure plate to the support structure for selectively disposing the pressure plate transversely across the bottom of the support structure in the compacting position and extending angularly upwardly from the bottom of the support structure in the retracted position.

7. A refuse compactor comprising:

a cabinet;

a drawer defining a compacting space in which refuse is disposed to be compacted and having an open top through which refuse may be passed;

means for movably mounting the drawer to the cabinet for selective positioning in a compacting position within the cabinet and an access position outwardly of the cabinet for facilitated introduction of gross amounts of refuse thereinto;

ram means in said cabinet;

means for moving the ram means selectively between a retracted position closely above the drawer open top with the drawer in its compacting position and a compacting position wherein the ram engages and forcibly compacts the refuse in the drawer in its compacting position;

means for causing the configuration of the ram means in the retracted position to be different from that of the ram means in its compacting position to define a small delivery passage above the drawer within the cabinet providing limited access to the drawer open top in the compacting position of the drawer; and means for providing controlled access from exteriorly of the cabinet to said delivery passage for introduction of small amounts of refuse through the delivery passage into the drawer with the drawer in its compacting position notwithstanding the disposition of the retracted ram means closely above the drawer.

8. The refuse compactor of claim 7 wherein the ram means includes a support structure and a pressure plate at the bottom of the support structure, and means for pivotally mounting the pressure plate to the support structure for selectively disposing the pressure plate transversely across the bottom of the support structure in the compacting position and extending angularly upwardly from the bottom of the support structure in the retracted position.

9. The refuse compactor of claim 7 wherein said cabinet includes a fixed front wall and said access opening is disposed in the front wall.

10. The refuse compactor of claim 7 wherein said cabinet includes a fixed front wall, said access opening is disposed in the front wall, and a door is movably mounted on the cabinet for selectively closing the access opening.

11. The refuse compactor of claim 7 wherein said access opening extends vertically upwardly from substantially the level of said drawer open top.

12. The refuse compactor of claim 7 wherein means are provided for effectively locking the ram means in a refuse compacting configuration in the compacting position.

13. The refuse compactor of claim 7 wherein the ram means includes a support structure and a pressure plate at the bottom of the support structure, and means for pivotally mounting the pressure plate to the support structure for selectively disposing the pressure plate transversely across the bottom of the support structure in the compacting position and extending angularly upwardly from the bottom of the support structure in the retracted position, said support structure including a pair of spaced side walls at opposite sides of said pressure plate and cooperating with said pressure plate to define a chute for guiding refuse from said access opening to said drawer.

14. The refuse compactor of claim 7 wherein the ram means includes a support structure and a pressure plate at the bottom of the support structure, means for pivotally mounting the pressure plate to the support structure, and cam means carried by the cabinet and responsive to movement of the ram means to the compacting and retracted position for selectively disposing the pressure plate transversely across the bottom of the support structure in the compacting position and extending angularly upwardly from the bottom of the support structure in the retracted position.

15. The refuse compactor of claim 7 wherein said cabinet includes a front wall and said access opening is disposed in the front wall, said ram means being disposed immediately rearwardly of the access opening in the retracted position thereof.

16. The refuse compactor of claim 7 wherein said ram means defines a parallelepiped configuration in said compacting position.

17. A refuse compactor comprising: a cabinet; a drawer defining an upwardly opening compacting space in which refuse is disposed to be compacted; ram means; means for moving the ram means selectively between a retracted position adjacent the top of the drawer and a compacting position wherein the ram engages and forcibly compacts the refuse in the drawer; means for disposing the drawer selectively in a compacting position within the cabinet below the ram and a loading position forwardly of the cabinet for providing substantially free access to the drawer for facilitated introduction of refuse thereinto; means defining an access opening in the cabinet above the drawer; and means for causing the configuration of the ram means in the retracted position to be different from that of the ram means in the compacting position to provide limited access to the drawer for introduction of small trash elements through said access opening into the drawer within the cabinet in the compacting position notwithstanding the disposition of the ram means at the top of the drawer, said ram means including a support structure and a pressure plate at the bottom of the support structure, means for pivotally mounting the pressure plate to the support structure for selectively disposing the pressure plate transversely across the bottom of the support structure in the compacting position and extending angularly upwardly from the bottom of the support structure in the retracted position, and means extending between the support and pressure plate for controlling the positioning of said pressure plate including toggle means.

18. A refuse compactor comprising: a cabinet; a drawer defining an upwardly opening compacting space in which refuse is disposed to be compacted; ram means; means for moving the ram means selectively between a retracted position adjacent the top of the drawer and a compacting position wherein the ram engages and forcibly compacts the refuse in the drawer; means for disposing the drawer selectively in a compacting position within the cabinet below the ram and a loading position forwardly of the cabinet for providing substantially free access to the drawer for facilitated introduction of refuse thereinto; means defining an access opening in the cabinet above the drawer; and means for causing the configuration of the ram means in the retracted position to be different from that of the ram means in the compacting position to provide limited access to the drawer for introduction of small trash elements through said access opening into the drawer within the cabinet in the compacting position notwithstanding the disposition of the ram means at the top of the drawer, said means for causing the configuration of the ram means to change including articulated linkage means and means for arranging the linkage means to have only columnar loading in the compacting position.

19. In a refuse compacting apparatus including a receptacle with an open end for receiving refuse to be compacted therein and a reciprocally movable ram means adapted to move into the receptacle and compact the refuse therein and retract to a retracted position, a ram face portion carried on the ram means, said ram means further including a pivotally mounted arm providing support for the ram face portion, said pivotally mounted arm being arranged to pivot as the ram means retracts to thereby move the ram face portion relative to the ram means between an operative compacting position wherein it is disposed closely adjacent the open end of the receptacle and a receptacle-access position wherein it is disposed at least partially away from the receptacle open end to permit access to the receptacle open end for the deposit of refuse in the receptacle.

20. The apparatus of claim 19 further including a stationary member that is contacted by the arm as the ram means moves whereby the arm is caused to pivot on the ram means.

21. The apparatus of claim 19 wherein said ram means includes a box-like structure to which said arm is pivotally mounted and to which said ram face is pivotally mounted opposite said first pivotal mounting.

22. A domestic refuse compacting appliance comprising:

a support frame with an appearance front attached thereto;

a ram means adapted for vertical movement from a retracted position and through a compacting cycle;

a receptacle having an open top end and being disposed below the ram means for holding refuse to be compacted;

the ram means having a ram head for compacting movement into and out of the receptacle and including a pivotally mounted arm providing support for the ram head, the pivotally mounted arm being arranged to pivot as the ram means retracts to thereby move the ram head portion relative to the ram means;

a loading port in the appliance front at a level above the receptacle's top opening for the depositing of refuse into the receptacle; and the ram head being movable on the ram means between a first position and a second position whereby the front edge of the ram head is disposed away from the receptacle open end when in one of said positions to permit passage of refuse into the receptacle from the loading port.

23. The compacting appliance of claim 22 wherein the loading port has an access door thereacross, and the door is adapted to be opened to permit refuse to be deposited inwardly to the loading port.

* * * * *